US005473220A

United States Patent [19]

Sato et al.

[11] Patent Number: 5,473,220

[45] Date of Patent: Dec. 5, 1995

[54] DISCHARGE TUBE

[75] Inventors: Takashi Sato; Takahisa Suzuki; Tetsuya Mitani; Hiromitsu Tsuchiya, all of Shizuoka, Japan

[73] Assignee: Yazaki Corp., Tokyo, Japan

[21] Appl. No.: 417,271

[22] Filed: Apr. 5, 1995

Related U.S. Application Data

[63] Continuation of Ser. No. 127,275, Sep. 27, 1993, abandoned.

[30] Foreign Application Priority Data

Oct. 6, 1992 [JP] Japan ..... 4-069539 U

[51] Int. Cl.[6] ..... H01J 61/35

[52] U.S. Cl. ..... 313/635; 313/325; 313/589

[58] Field of Search ..... 313/635, 589, 313/325

[56] References Cited

U.S. PATENT DOCUMENTS 5,103,135 4/1992 Lange et al. ..... 313/635

5,235,247 8/1993 Shishida et al. ..... 313/325 X

FOREIGN PATENT DOCUMENTS 3-68389 7/1991 Japan .

4-133244 5/1992 Japan .

*Primary Examiner*—Donald J. Yusko

*Assistant Examiner*—Nimesh D. Patel

*Attorney, Agent, or Firm*—Nikaido Marmelstein Murray & Oram

[57] ABSTRACT

A discharge tube according to the present invention is constructed such that it comprises a cylindrical container made of an insulation tube, a pair of discharge electrodes provided at opposite ends of the cylindrical container, a plurality of insulation coated lines containing a gas-ionization accelerator therein, which insulation coated lines being provided on the inner surface of the cylindrical container covering the regions surrounding a cathode and a discharge space therein in a substantially parallel relation with a center axis of the cylindrical container, wherein the gas-ionization accelerator is made of a silicate powder selected from the group of alkaline metal, alkaline earth metal and so on, or of electrically conductive finely divided particles selected from the group of carbon, metal, metal oxide and so on. The discharge tube according to the present invention shows stabilized discharge inception characteristics even when the frequency of repetitive discharge is low, and in addition, it does not generate an inner creeping discharge even if it is continuously used for a long time, thereby providing a stabilized discharge operation.

6 Claims, 2 Drawing Sheets

DISCHARGE TUBE

This application is a continuation of application Ser. No. 08/127,275 filed Sep. 27, 1993, now abandoned.

BACKGROUND OF THE INVENTION

1. Field of the Invention

The present invention relates to a discharge tube, and more particularly to a discharge tube having a stabilized discharge inception characteristics suitably used for a voltage controller, a gap switch, a sharpener gap and so on.

2. Description of the Invention

Generally, a discharge tube is adopted in a voltage controlling device, or in a gap switch for correctly controlling a discharge inception of a pulse laser or the like, and as a discharge tube suitable for this purpose there has been provided a discharge tube which comprises a cylindrical container made of an insulation tube provided with a pair of discharge electrodes at opposite sides thereof, and having an inert gas sealed therein.

The discharge tube as constructed above in general has a tendency that when the frequency of repetitive discharge becomes low, a discharge inception is delayed and a discharge inception voltage is thereby raised. However, it is not desirable that the discharge inception voltage changes according to the discharge frequency, and in fact, a discharge inception voltage in a discharge tube should be stabilized regardless of the above frequency of repetitive discharge.

In view of these defects to be overcome, there has been invented a discharge tube which is capable of accelerating an inception of the main discharge by providing trigger lines made of conductive layers or the like respectively extending from opposite electrodes on the inner surface of a cylindrical container which is a main body of the discharge tube. However, in the discharge tube as constructed above, when the discharge is repeated for a long time, the trigger lines are worn and thereby the trigger effect thereof does not last long, and in addition, an abnormal discharge creeping, that is, so called an inner creeping discharge along the inner surface of the cylindrical container is likely to occur.

In view of the above phenomena, there has also been proposed a discharge tube which is capable of accelerating a preionization of the gas sealed in a discharge space thereof, avoiding thereby the delay of an inception of discharge even when the frequency of repetitive discharge is substantially low, for example, by dispersively building up a small amount of electrically conductive substance on the inner surface of the cylindrical container (as shown in Japanese Patent Application Laid-open No. 3-68389), or by coating an insulation coating substance containing a gasionization accelerator such as a silicate compound of alkaline metal on the inner surface of the cylinder (as shown in Japanese Patent Application Laid-open No. 4-133244). However, even a discharge tube as constructed above could not perfectly solve such a problem that the inner creeping discharge is more likely to occur in proportion to the cumulative number of discharge, in spite of the fact that it is provided with a stabilized discharge inception.

The present invention has been made to eliminate such problems, and it is an object of the present invention to provide a discharge tube which has a stabilized discharge inception characteristics regardless of the frequency of repetitive discharge or of the cumulative number of discharge, yet capable of eliminating an occurrence of inner creeping discharge by building up a gas ionization accelerator at specified regions within the cylindrical container.

SUMMARY OF THE INVENTION

In order to accomplish the above object, an electric discharge tube according to the present invention is constructed such that it comprises a cylindrical container made of an insulation tube, a pair of discharge electrodes provided at opposite ends of the container, a plurality of insulation coated lines containing a gas-ionization accelerator therein, which insulation coated lines being provided on the inner surface of the container covering the regions surrounding a cathode electrode and a discharge space therein in a substantially parallel relation with a center axis of the cylindrical container, and further, the gas-ionization accelerator is made of a silicate powder selected from the group of alkaline metal, alkaline earth metal and so on, or of an electrically conductive finely divided particles selected from the group of carbon, metal, metal oxide and so on.

The discharge tube according to the present invention shows a stabilized discharge inception characteristics even when the frequency of repetitive discharge is low, and in addition, it does not generate an inner creeping discharge even if it is continuously used for a long time, thereby providing a stabilized discharging operation.

BRIEF DESCRIPTION OF THE DRAWINGS

The present invention becomes more fully understood from the detailed description given hereinbelow and the accompanying drawings which are given by way of illustration only, and thus are not limitative of the present invention and wherein.

DESCRIPTION OF THE PREFERRED EMBODIMENTS

In the following, several embodiments of the present invention are described with reference to the accompanying drawings.

Figure 1:
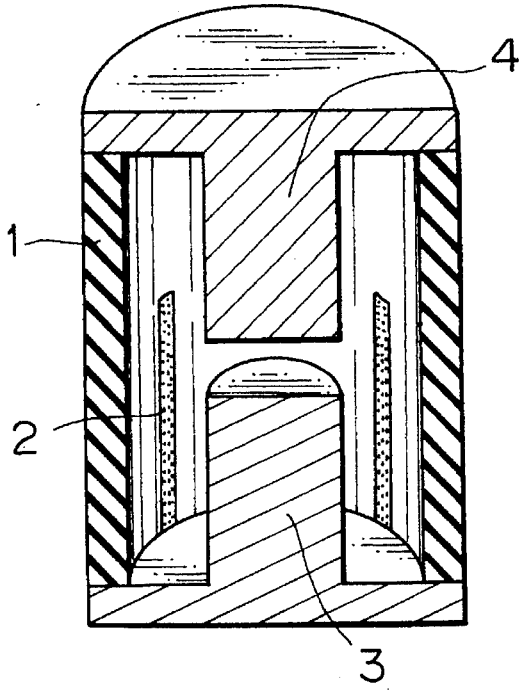
FIG. 1 is a sectional view showing one embodiment of the structure of a discharge tube of the present invention.

FIG. 1 is an illustration showing a structure of the discharge tube A as a first embodiment of the present invention.

In the same figure, in a cylindrical container 1 which is formed of an electrically insulating material such as ceramics (hereinafter referred to just as a cylinder or a container) and having an inner diameter of 11 mm and a vertical length of 16 mm, a coating compound which is a mixture of water and silicate glass powder of barium soda (which is a product of NIHON DENKI GLASS with a product number ST-W/K) is coated and dried to form a plurality of coated lines 2, each of which having a width of 2 mm and extending for 9 mm from one end of the cylinder 1, in such a form that they mutually make an angle of 120° with respect to the center axis of the inner surface of the cylinder.

In addition, a cylindrical electrode 3 having an external diameter of 5 mm and a vertical length of 7 mm is inserted from the same end from which side the coated lines 2 are extended to make a cathode (although "a cathode electrode"

or "an anode electrode" is sometimes used, "a cathode" or "an anode" is usually used in the field of discharge physics or discharge engineering), while another electrode 4 having the same cylindrical form as that of 3 is inserted from the other end and fixed in such a way that the both electrodes are disposed in a face-to-face relation with a mutual distance of 2 mm therebetween, wherein argon gas is injected to an atmospheric pressure of 9 atm. and sealed therein.

Figure 2:
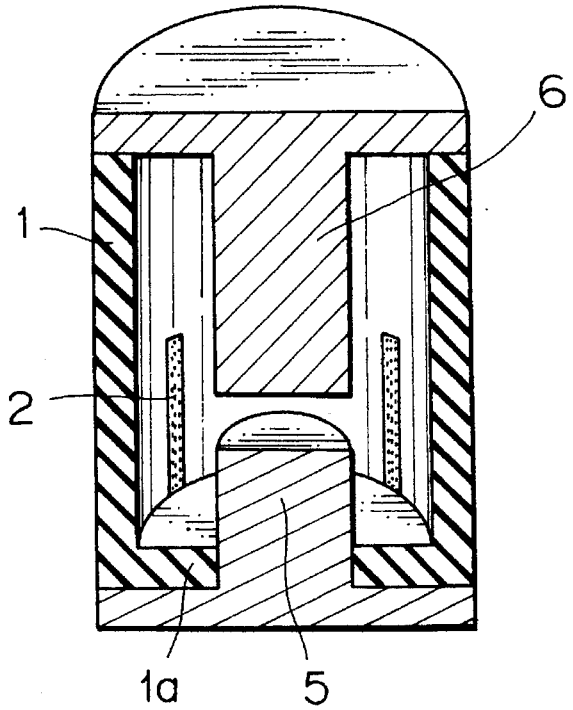
FIG. 2 is a sectional view showing another embodiment of the structure of a discharge tube of the present invention.

On the other hand, FIG. 2 is an illustration showing a structure of the discharge tube B as a second embodiment of the present invention.

In the same figure, in a cylindrical ceramic container 1 (referred to just as a cylinder or a container) having an inner diameter of 11 mm and a vertical length of 16 mm, a coating compound which is a mixture of a compound substance of 5 parts of alumina impalpable powder and 1 part of carbon black and water containing 20% of alcohol, is coated and dried to make a plurality of coated lines 2, each of which having a width of 2 mm and extending for 5 mm from the inner side of a flange 1*a* whose width and depth are respectively 2.5 mm and 2 mm and protruding inwardly from one end of the cylinder 1, wherein the coated lines are formed in such a mode that they mutually make an angle of 90° with respect to the center axis of the inner surface of the cylinder.

In addition, a cylindrical electrode 5 having an external diameter of 5 mm and a vertical length of 5 mm is inserted through a hole of the flange 1*a* to make a cathode, while another electrode 6, whose external diameter and the vertical length are respectively 5 mm and 9 mm, is inserted from the other end of the cylinder in such a way that the both electrodes are disposed in a face-to-face relation with a mutual distance of 2 mm therebetween, wherein argon gas is injected to an atmospheric pressure of 9 atm. and sealed therein.

By the way, the following are reference embodiments 1' and 2', but are provided only for comparing with above embodiments of the present invention, wherein the reference embodiment 1' showing namely a discharge tube C is constructed just like the above first embodiment 1 except that there is no coated lines provided on the inner surface of the cylinder 1, whereas the reference embodiment 2' showing namely a discharge tube D is constructed just like the above first embodiment 2 except that the above coating compound is coated on the entire inner surface of the cylinder 1.

(Experiment)

Figure 3:
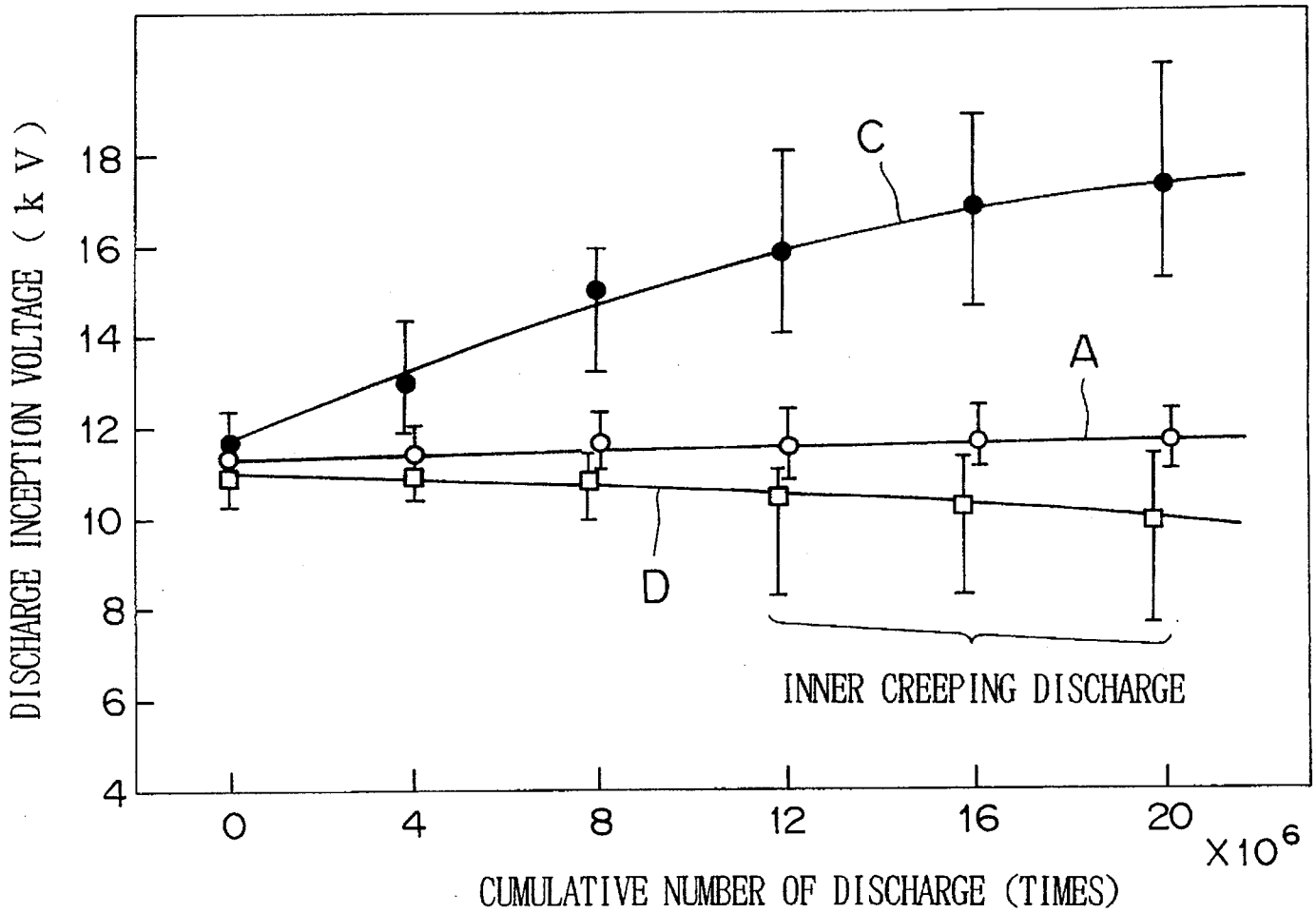
FIG. 3 is a graph showing the difference between the discharge inception of the present invention and that of the prior art.

With respect to the above four discharge tubes, the same experiment is executed in which an anode is grounded, and a minus high voltage of a respective frequency of 0.2 Hz is applied to the cathode to make a discharge, and a scattering result and a deterioration with time lapse of a discharge inception voltage (kV) are investigated as shown in FIG. 3. From this experiment, it can be known that a discharge inception of the discharge tube C of the reference embodiment 1' has scattering results and the discharge inception voltage gradually rises, whereas the discharge tube D of the reference embodiment 2' generates an inner creeping discharge in accordance with its deterioration, and thus a discharge occurs even while the electric voltage is not substantially high, which is not a preferable phenomenon.

On the other hand, the discharge tube A of the present invention shows a stabilized discharge inception even when a cumulative number of discharges becomes large, whereby it becomes obvious that there is no inner creeping discharge occurred, and there is no change in the discharge inception characteristics even after repetitions of discharge for a long time.

It is to be noted that after the same kind of experiment, the discharge tube B has more or less a similar result as that of the discharge tube A.

[Effect of the Invention]

In the discharge tube of the present invention, since insulation coated lines containing a gas ionization accelerator are coated at specified regions of the inner surface of the cylinder, not only the discharge inception is stabilized, but it can also maintain a stabilized discharge voltage characteristics even after a long-time repetition of discharging operation, so that the lifetime of the discharge tube is long, and the reliability thereof is sufficiently high.

While the invention has been described with reference to specific embodiments, the description is illustrative and is not construed as limiting the scope of the invention. Various modifications and changes may occur to those skilled in the art without departing from the spirit and scope of the invention as defined by the appended claims.

What is claimed is;

1. A discharge tube comprising:

a cylinder made of an insulation tube;

a pair of discharge electrodes provided at opposite ends of said cylinder, said discharge electrodes sealing an inert gas in said cylinder; and a plurality of insulation coated lines containing a gas-ionization accelerator therein, said insulation coated lines being provided on the inner surface of said cylinder covering the regions surrounding a cathode thereof and a discharge space within said cylinder axis of said cylinder, wherein said insulation coated lines are provided such that they form a mutually 120° angle with respect to a center axis of the inner surface of said cylinder, said insulation coated lines being formed only at the cathode side.

2. A discharge tube as claimed in claim 1, wherein said gas-ionization accelerator is made of a silicate powder selected from the group of alkaline metal and alkaline earth metal.

3. A discharge tube as claimed in claim 1, wherein said gas-ionization accelerator is made of electrically conductive finely divided particles selected from the group of carbon, metal and metal oxide.

4. A discharge tube comprising:

a cylinder made of an insulation tube;

a pair of discharge electrodes provided at opposite ends of said cylinder, said discharge electrodes sealing an inert gas in said cylinder; and a plurality of insulation coated lines containing a gas-ionization accelerator therein, said insulation coated lines being provided on the inner surface of said cylinder covering the regions surrounding a cathode thereof and a discharge space within said cylinder axis of said cylinder, wherein said insulation coated lines are provided such that they form a mutually 90° angle with respect to a center axis of the inner surface of said cylinder, said insulation coated lines being formed only at the cathode side.

5. A discharge tube as claimed in claim 4, wherein said gas-ionization accelerator is made of a silicate powder selected from the group of alkaline metal and alkaline earth metal.

6. A discharge tube as claimed in claim 4, wherein said gas-ionization accelerator is made of electrically conductive finely divided particles selected from the group of carbon, metal and metal oxide.

* * * * *